US006116914A

United States Patent [19]

Koide

[11] Patent Number: 6,116,914

[45] Date of Patent: Sep. 12, 2000

[54] CONNECTOR FOR A CIRCUIT BOARD

[75] Inventor: Takashi Koide, Yokkaichi, Japan

[73] Assignee: Sumitomo Wiring Systems, Ltd., Japan

[21] Appl. No.: 09/238,834

[22] Filed: Jan. 28, 1999

[30] Foreign Application Priority Data

Feb. 4, 1998 [JP] Japan ..... 10-023621

[51] Int. Cl.[7] ..... H01R 12/00

[52] U.S. Cl. ..... 439/63; 439/581

[58] Field of Search ..... 439/63, 80, 81, 439/581, 578

[56] References Cited

U.S. PATENT DOCUMENTS

| | | | |
|---|---|---|---|
| 4,410,230 | 10/1983 | SanMiguel | 439/63 |
| 4,445,745 | 5/1984 | Cartesse | 439/63 |
| 4,605,269 | 8/1986 | Cohen et al. | 439/63 |
| 4,846,711 | 7/1989 | Kobler et al. | 439/63 |
| 4,946,392 | 8/1990 | Kobler et al. | 439/63 |
| 5,011,415 | 4/1991 | Suzuki et al. | 439/63 |
| 5,017,156 | 5/1991 | Sugiyama | 439/607 |
| 5,046,952 | 9/1991 | Cohen et al. | 439/63 |
| 5,169,340 | 12/1992 | Nakata et al. | 439/607 |
| 5,645,454 | 7/1997 | Kosmala | 439/675 |
| 5,842,872 | 12/1998 | Hosler, Sr. et al. | 439/63 |

FOREIGN PATENT DOCUMENTS

WO 86/00473 1/1986 WIPO .

*Primary Examiner*—Brian Sircus
*Assistant Examiner*—T. C. Patel
*Attorney, Agent, or Firm*—Anthony J. Casella; Gerald E. Hespos; Michael J. Porco

[57] ABSTRACT

A connector is provided to ensure the strength of a tubular engaging portion and to prevent a breakage of a locking portion during connection with a mating connector. The connector includes a terminal fitting 20 that is inserted to a proper position in a tubular engaging portion 11 of a housing. Locking portions 33 are formed on the outer surfaces of the terminal fitting 20 and are engaged with lock recesses 18 formed in the inner surfaces of the engaging portion 11. As a result the terminal fitting 20 is held so as not to come out. The locking recesses 18 are formed by recessing small portions of the inner surfaces of the engaging portion 11 sufficient to be engaged with the leading ends of the locking portions 33 and, accordingly, do not bring about a reduction in the strength of the engaging portion 11. Further, since the locking portions 33 do not project from the outer surfaces of the engaging portion 11, there is no likelihood that the locking portions 33 are broken when a mating connector is fitted on the engaging portion 11.

10 Claims, 4 Drawing Sheets

CONNECTOR FOR A CIRCUIT BOARD

BACKGROUND OF THE INVENTION

1. Field of the Invention

The present invention relates to a connector for a circuit board.

2. Description of the Related Art

A known connector for a circuit board is disclosed in Japanese Utility Model Registration No. 2542233, and is illustrated in FIG. 7 herein. With reference to FIG. 7, this prior art connector is provided with a housing 1 made of a resin to be fixed to a circuit board (not shown). The housing 1 is formed with a tubular engaging portion 2 into which a terminal fitting (not shown) is inserted from behind and on which a mating connector (not shown) is fitted from front. The housing 1 also is formed with locking portions 3 for locking the terminal fitting in the upper and lower surfaces of the tubular engaging portion 2. The locking portions 3 are formed between a pair of slits 4 extending backward from the front edge of the tubular engaging portion 2 so as to project forwardly. During the insertion of the terminal fitting, the locking portions 3 deform elastically, and bulge out from the outer surfaces of the engaging portion 2 due to the engagement of lock projections 3A thereof with the outer surfaces of the terminal fitting. When the terminal fitting is inserted to its proper position, the lock projections 3A engage with lock holes formed in the terminal fitting, and the locking portions 3 are restored inwardly. As a result, the terminal fitting is held in the housing 1 so as not to come out.

The slits 4 that define the locking portions 3 in the above prior art connector for a circuit board extend in forward and backward directions from the end of the engaging portion 2. Thus the engaging portion 2 is not a complete tube having a continuous outer surface over its entire circumference. Accordingly, the engaging portion 2 may not have sufficient strength, is liable to be deformed and cannot securely protect the terminal fitting.

Further, the locking portions 3 bulge out from the engaging portion 2 if the terminal fitting is insufficiently inserted. Accordingly, if the mating connector is fitted on the engaging portion 2 in this state, it is brought into contact with the leading ends of the locking portions 3, which may in turn be broken.

In view of the above problems, an object of the present invention is to ensure the strength of an engaging portion and to prevent locking portions from being broken during the connection with a mating connector.

SUMMARY OF THE INVENTION

According to the invention, there is provided a connector that is mountable on a circuit board and that has a terminal fitting mounted in a housing thereof. An engaging portion is provided on or at the housing for permitting a mating connector to be fitted thereon from a mating direction. A connection section is provided on or at the terminal fitting. The connection section is inserted at least partially from an insertion direction along substantially the inner surface of the engaging portion so as to enable connection with a mating terminal fitting of the mating connector. A locking means is provided on or at the housing and the terminal fitting for substantially preventing the connection section from being disengaged from the engaging portion. The locking means comprises at least one lock recess formed in or on the inner surface of the engaging portion and at least one corresponding locking portion on the connection section. The locking portion on the connection section projects at an angle different from 0° or 180° with respect to the connection section and has a leading end that is engageable with the lock recess.

The locking recess is formed by recessing preferably a small portion of the inner surface of the engaging portion sufficiently to be engaged with the leading end of the locking portion. Accordingly, the locking recess does not bring about a substantial reduction in the strength of the engaging portion. Further, since the locking portion is accommodated (at least partially) in the engaging portion, there is no likelihood that the locking portion is broken when a mating connector is fitted on the engaging portion.

According to a preferred embodiment, the lock portion projects obliquely backwardly from the connection portion.

Preferably, the locking portion is formed by cutting a portion of the connection section and bending a cut portion obliquely backwardly. Accordingly, the locking portion can be formed at a low cost in a way that effectively prevents the connection section from being disengaged from the engaging portion. Further preferably, the locking portion is elastically deformable.

The engaging portion preferably is substantially tubular and/or the connection section is substantially tubular. Accordingly, a construction having an even higher strength can be provided.

According to a further preferred embodiment, there is provided a connector that is mountable on a circuit board with a terminal fitting mounted in a housing thereof. A tubular engaging portion is provided on or at the housing for permitting a mating connector to be fitted thereon from front. A tubular connection section is provided on or at the terminal fitting. The tubular connection section is inserted from behind along the inner surface of the tubular engaging portion so as to enable the connection with a mating terminal fitting. A locking means provided on or at the housing and the terminal fitting for preventing the tubular connection section from being disengaged from the tubular engaging portion. The locking means comprises a lock recess formed in the inner surface of the tubular engaging portion and an elastically deformable locking portion which is formed by cutting a portion of the tubular connection section and bending a cut portion obliquely backwardly. The locking portion has a leading end engageable with the lock recess.

The lock recess may be formed in a rear end position of the tubular engaging portion. Since the lock recess is provided in the rear end position, an area having a high strength stretches over a wide range of the tubular engaging portion from the front end to a middle portion. This enables a secure protection of the tubular connection section. Further, the terminal fitting is allowed to have a sufficient length before the lock recess for the formation of the locking portion. Thus, the reliability of the terminal fitting locking function can be improved by making the locking portion larger.

The terminal fitting may comprise an outer conductor, an insulating member and an inner conductor. The inner and outer conductors may be mounted to each other by the insulating member, and the engaging portion may be a part of the outer conductor.

The inner conductor and the insulating member may be at least partially insertable into the outer conductor in the insertion direction. Additionally, the outer conductor may comprise a wall portion that is bendable or positionable in such a position as to intersect the insertion direction. Accordingly, the inner conductor and the insulating member can be held securely in the outer conductor.

A portion of the engaging portion on which the lock recess is not provided preferably has a longitudinal length that is longer than half the longitudinal length of the terminal fitting.

These and other objects, features and advantages of the present invention will become more apparent upon a reading of the following detailed description and accompanying drawings.

DETAILED DESCRIPTION OF THE PREFERRED EMBODIMENT

A first embodiment of the invention is described with reference to FIGS. 1 to 6, and is comprised of a housing 10 made of a resin. The housing 10 is to be mounted on a circuit board (not shown) and a terminal fitting 20 is to be mounted in the housing 10 and connected with the circuit board.

Figure 2:
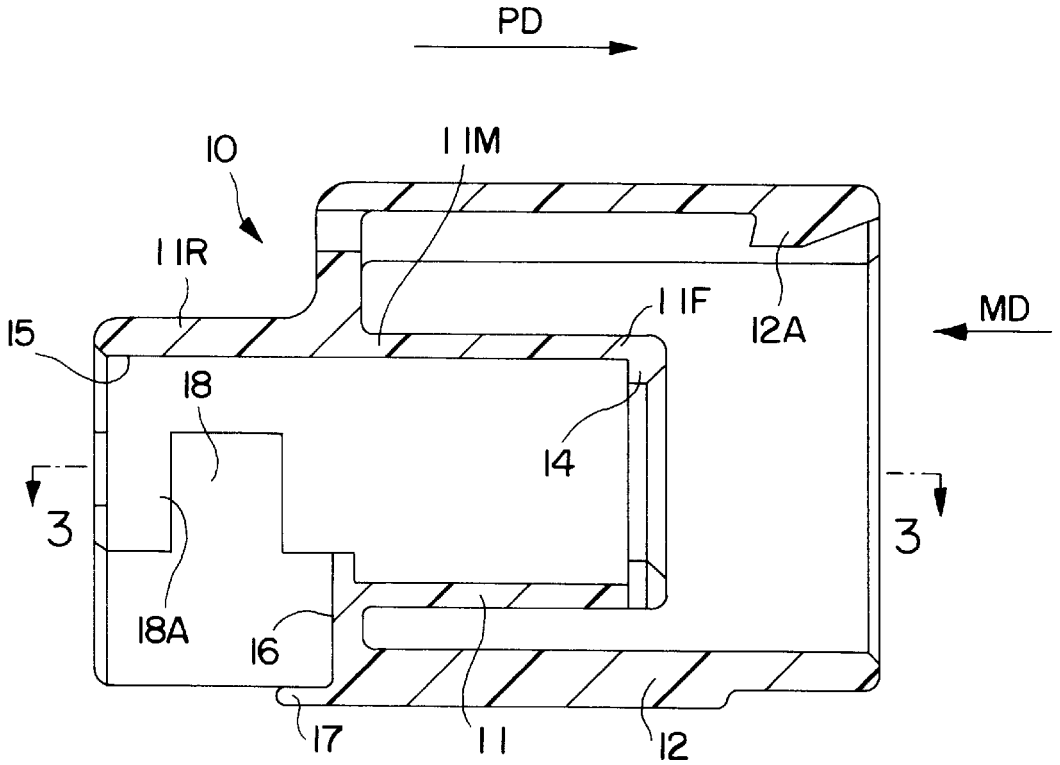
FIG. 2 is a vertical section of a housing.
Figure 3:
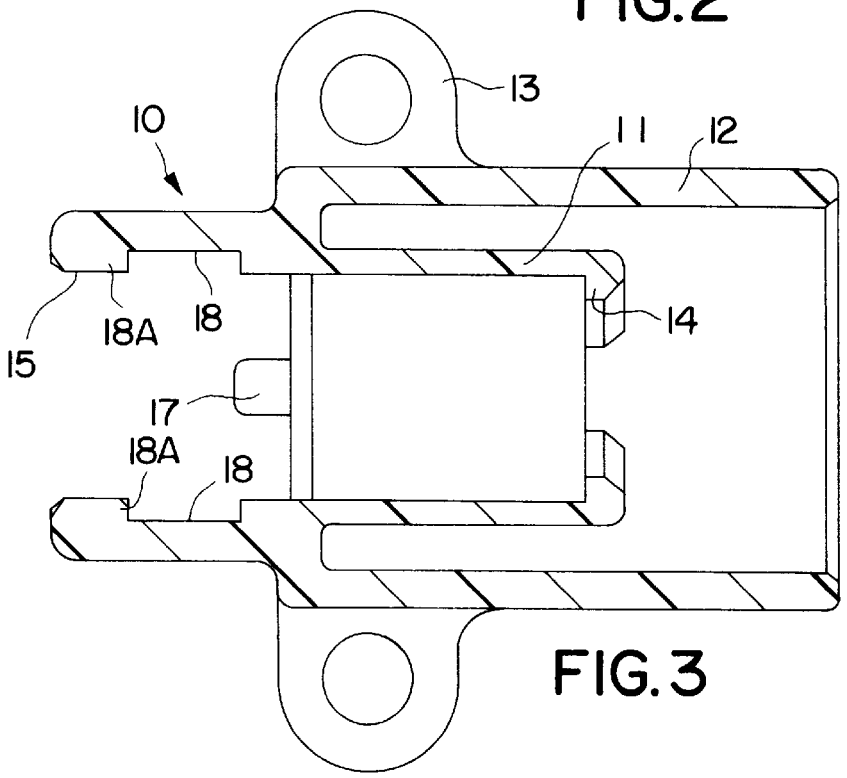
FIG. 3 is a section along 3—3 of FIG. 2.

The housing 10 is comprised of a tubular engaging portion 11 and a receptacle 12. The tubular engaging portion 11 has a substantially rectangular cross section and is substantially hollow throughout the length along a longitudinal direction thereof or in forward and backward directions. The receptacle 12 also has a substantially rectangular cross section and projects forwardly from a position on the outer surface of the engaging portion 11 slightly behind a middle position or portion 11M, as shown in FIG. 2. Mount portions 13 project from the opposite side surface substantially at the rear end of the receptacle 12.

The receptacle 12 projects more forwardly or in a projecting direction PD (FIG. 2) than the engaging portion 11, and is spaced apart from the outer surface of the engaging portion 11 so as to at least partially surround the engaging portion 11. A mating connector (not shown) is fitted or fittable in a mating direction MD between the engaging portion 11 and the receptacle 12, and is lockingly held or holdable by a lock projection 12A formed on the lower surface of the upper wall of the receptacle 12.

The mating connector is fitted or fittable at least partially on the engaging portion 11 as described above, and the terminal fitting 20, to be described later, is inserted at least partially thereinto from an insertion direction ID, preferably substantially from behind. The front end (11F) opening of the engaging portion 11 is formed to define a stopper 14 for stopping the leading end of the terminal fitting 20 in the longitudinal direction, and the rear end (11R) opening thereof acts as a terminal insertion opening 15. At the rear end of the engaging portion 11 is formed a notch 16 which is open in the lateral or lower surface of the engaging portion 11 so as to substantially communicate with the terminal insertion opening 15. Connection portions 30, 39 of the terminal fitting 20 with the circuit board project downwardly through the notch 16. The front edge of the notch 16 includes a receiving projection 17 for receiving the terminal fitting 20 from a lateral side or below.

Inner surfaces of the engaging portion 11 are formed to define lock recesses 18 which function as lock means for locking the terminal fitting 20 substantially in its proper insertion position. The lock recesses 18 are formed at or in the vicinity of or adjacent to the rear end 11R of the engaging portion 11 e.g. by substantially rectangularly thinning the left and right side walls. Locking portions 33 of the terminal fitting 20 are engaged or engageable with stepped or projecting portions 18A left behind the lock recesses 18 from front or in an engagement direction. It should be noted that the lock recesses 18 and the notch 16 therebelow are substantially flush with each other due to a necessity to detach the molded housing 10 from a mold.

The terminal fitting 20 is comprised of a substantially box-shaped outer conductor 21 having an electrical conductivity, an L-shaped inner conductor 22 having an electrical conductivity and an insulating member 23 for assembling or mounting the outer and inner conductors 21, 22 in an insulated manner.

Figure 1:
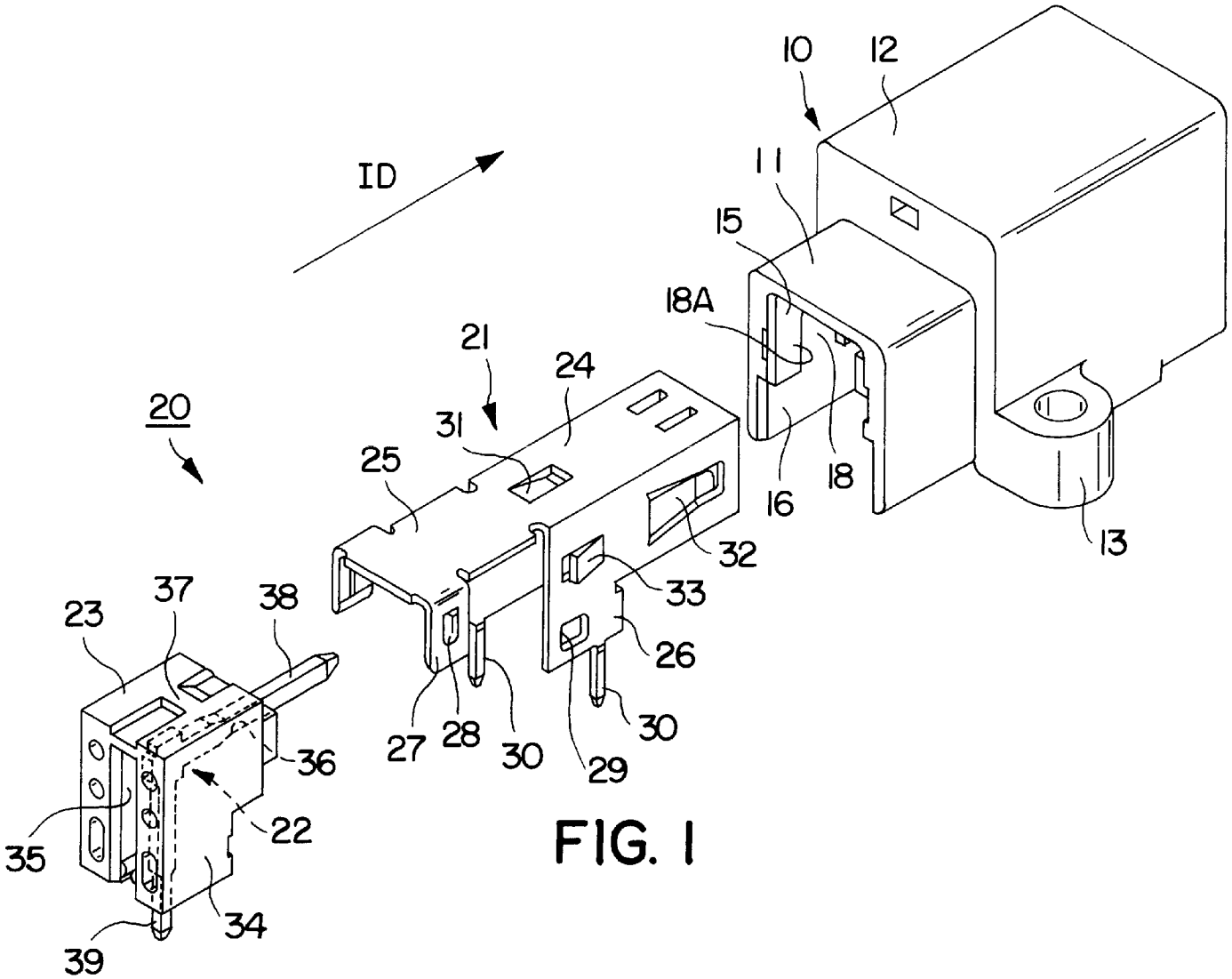
FIG. 1 is an exploded perspective view of a first embodiment.
Figure 4:
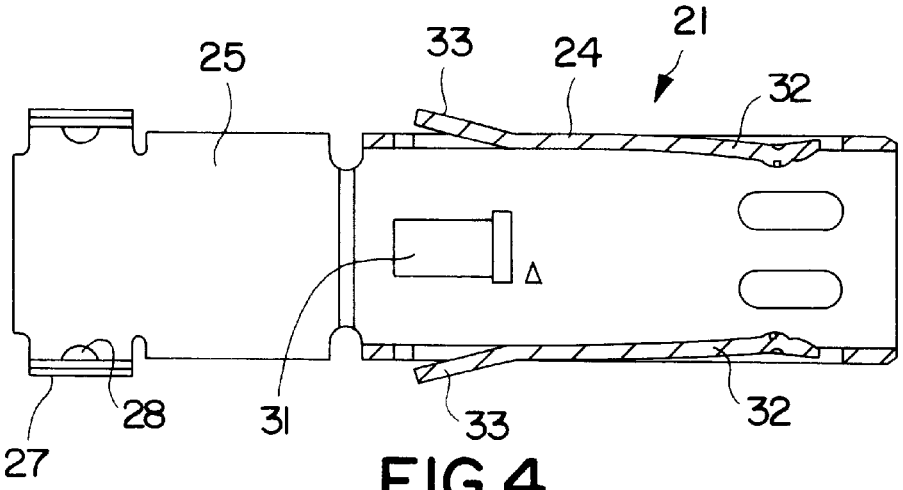
FIG. 4 is a plan view of a terminal fitting before an inner conductor is mounted.
Figure 5:
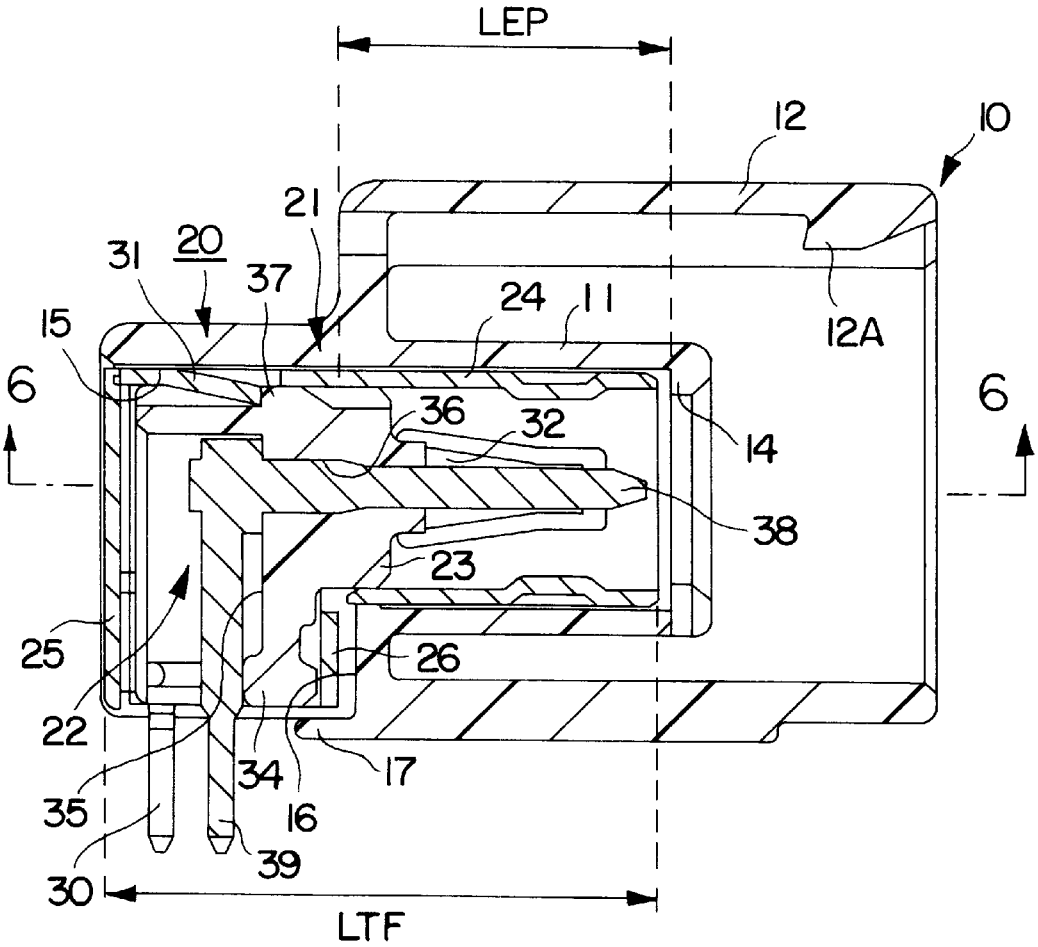
FIG. 5 is a vertical section of a connector in its assembled state.
Figure 6:
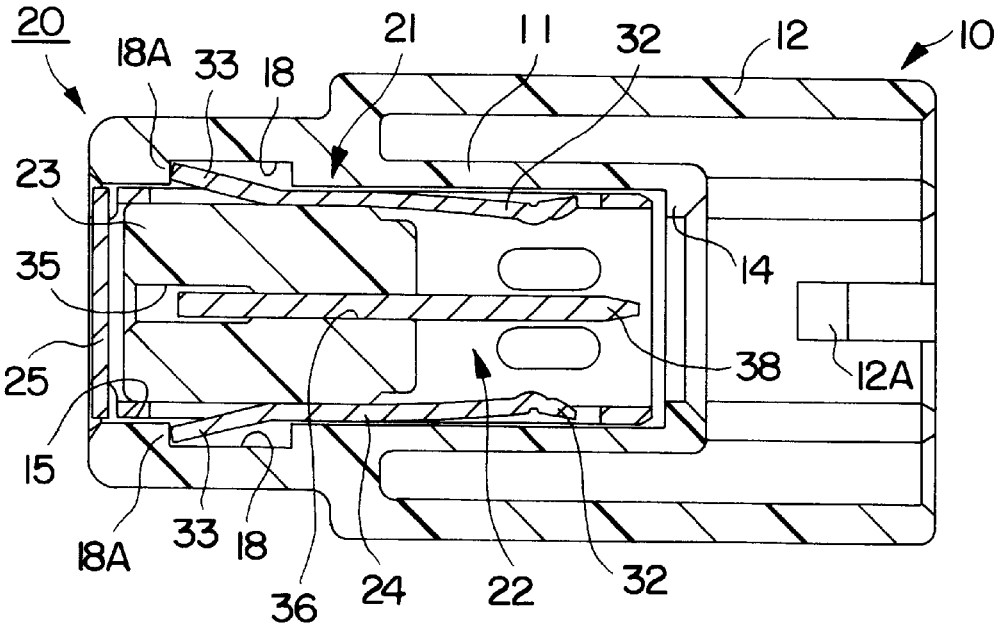
FIG. 6 is a section along 6—6 of FIG. 5.
Figure 7:
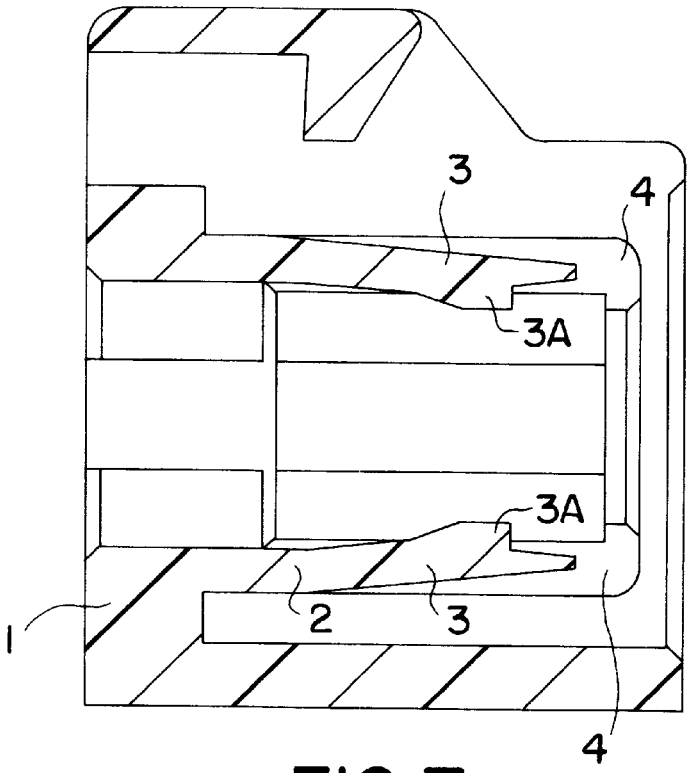
FIG. 7 PRIOR ART
FIG. 7 is a section of a prior art housing.

The outer conductor 21 is formed e.g. by bending a metal sheet punched into a specified shape by a press and includes a substantially tubular or at least partly laterally open connection section 24 insertable along the inner surface of the tubular engaging portion 11, a rear wall portion 25 for substantially closing the rear end surface of the connection section 24 (when fully mounted or assembled), and leg portions 26 slightly extending downwardly from the rear end of the connection section 24. The rear wall portion 25 extends substantially flush with the upper surface of the connection section 24, as shown in FIGS. 1 and 4, before the insulating member 23 is assembled. The rear wall portion 25 is bent at an angle different from 0° or 180° with respect to the connection section 24, preferably substantially downward after the insulating member 23 is substantially accommodated in the connection section 24 so as to substantially hold or position the insulating member 23. The rear wall portion 25 is held bent preferably downwardly by substantially engaging lock projections 28 formed on locking portion 27 extending from the leading end (bottom end) thereof with lock holes 29 formed in the leg portions 26. On the bottom edges of the left and right leg portions 26 are formed angled or downward extending connection portions 30 to be connected with the circuit board.

An elastic locking or restricting portion 31 for restricting a loose backward or longitudinal movement of the assembled insulating member 23 is formed preferably at the rear end of the upper surface of the connection section 24. Further, a pair of elastic contact portions 32 formed e.g. by cutting and bending portions of the side walls of the connection section 24 are provided preferably in front end positions. The elastic contact portions 32 project obliquely and preferably forwardly toward the inside so as to be elastically brought or bringable into contact with an unillustrated mating terminal fitting. On the other hand, a pair of locking portions 33 (locking means) project obliquely or at an angle different from 0° or 180° with respect to the connection section 24, preferably substantially backwardly toward the outside. The locking portions 33 are formed by cutting and bending portions of the opposite side walls of the connection section 24 preferably substantially in rear end positions or substantially at the end or area opposed to the mating side. These locking portions 33 have their leading ends engaged or engageable with the stepped portions 18A of the lock recesses 18 to restrict a loose backward movement of the terminal fitting 20 with respect to the housing 10.

The insulating member 23 has a substantially rectangular shape so as to be at least partially fittable into the rear end of the connection section 24. A projected portion 34 is formed on the lateral or lower surface of a rear area of the insulating member 23 and is engageable with the leg portions 26. A mount recess 35, preferably in the form of a slit, is formed in the rear surface of the insulating member 23, and a mount hole 36 extending to the front or engaging surface of the insulating member 23 is formed at the back end of the insulating member 23. Further, a receiving stepped portion 37 is formed preferably in the lateral or upper surface of the insulating member 23, and is engageable with the elastic lock portion 31 of the external conductor 21.

A substantially horizontal portion of the inner conductor 22 extends forwardly, or in a direction toward the receptacle 12 (when mounted), and acts as a contact portion 38 with the mating terminal fitting. An angled or preferably substantially vertical portion of the inner conductor 22 extends at an angle different from 0° or 180° with respect to the contact portion 38, preferably substantially downwardly, and acts as a connection portion 39 with the circuit board.

The inner conductor 22 and the insulating member 23 are assembled integrally by at least partially inserting the connection portion 38 through the mount recess 35 and pushing it into the mount hole 36. When this assembly is fitted at least partially into the external conductor 21, with the rear wall portion 25 open, the projected portion 34 is engaged with the engaging or rear surfaces of the leg portions 26 and the elastic lock portion 31 is or can be engaged with the receiving stepped portion 37. As a result, loose movements of the insulating member 23 and the inner conductor 22 with respect to the outer conductor 21 along longitudinal or forward and backward directions are restricted. When the rear wall portion 25 is bent downwardly in this state, the outer conductor 21, the inner conductor 22 and the insulating member 23 are made into an integral unit, thereby substantially completing the assembling of the terminal fitting 20.

The terminal fitting 20, thus assembled, is or can be assembled into the housing 10 by at least partially inserting the connection section 24 into the engaging portion 11, preferably from behind (side of the rear end 11R). When the terminal fitting 20 approaches its proper insertion position during the insertion of the terminal fitting 20, the locking portions 33 are brought or are bringable substantially into engagement with the inner surfaces of the engaging portion 11, thereby being deformed elastically inwardly. Thereafter, as the terminal fitting 20 is inserted slightly further, the leading end of the terminal fitting 20 comes into contact with or comes into proximity to the stopper 14. The terminal fitting 20 thus reaches its proper insertion position and, at the substantially same time, the locking portions 33 are elastically restored to substantially engage the lock recesses 18. The terminal fitting 20 is held so as not to come out preferably by the engagement of the locking portions 33 and the lock recesses 18. With the terminal fitting 20 properly inserted, the leg portions 26 thereof are engaged or engageable with the notch 16 as well as the receiving projection 17.

As described above, the engaging portion 11 is formed with the lock recesses 18 as a locking means instead of a long slit, as with the prior art locking portion formed in the housing. Further, since the lock recesses 18 are formed by thinning a part of the engaging portion 11 and are not open in the outer surface, a high strength can be ensured for the entire engaging portion 11.

This enhances the performance of the engaging portion 11 to protect the terminal fitting 20. The engaging portion 11 is unlikely to be deformed or pried (at its front end 11F and middle portion 11M) even if the mating connector and/or mating terminal fitting is struck against or is obliquely fitted into the engaging portion 11. In this respect, the engaging portion 11 has an excellent performance to retain the terminal fitting 20.

Further, since the lock recesses 18 are provided substantially in or at the rear end (11R) positions, an area having a high strength stretches over a wide range from the front end 11F to the middle portion 11M. This also enhances the protecting performance. Preferably, the engaging portion 11 has a longitudinal length LEP from the front end 11F to the middle portion 11M thereof (i.e. where the lock recess 18 preferably is not provided) of at least half the longitudinal length LTF of the terminal fitting 20 or substantially greater than a mating length of the terminal fitting 20 with a mating connector (not shown).

Further, by providing the lock recesses 18 in the rear end positions, the terminal fitting 20 is allowed to have a sufficient length before the lock recesses 18 for the formation of the locking portions 33. Thus, the reliability of the terminal fitting locking function can be improved by making the locking portions 33 larger.

A sliding resistance between the deformed locking portions 33 and the inner surfaces of the engaging portion 11 during the insertion of the terminal fitting 20 acts in a small region extending from a position where the terminal fitting 20 is considerably inserted to the proper insertion position. Thus, there is little likelihood that operability is reduced due to a sliding resistance.

Further, since the locking portions 33 are accommodated in the engaging portion 11, the mating connector is not likely to damage the locking portions 33 when being fitted on the engaging portion 11.

The present invention is not limited to the described and illustrated embodiment, but the following embodiments are also embraced by the technical scope of the present invention as defined in the claims. Besides the following embodiments, a variety of other changes can be made without departing from the scope and spirit of the invention as defined in the claims.

Although the lock recesses are provided in the rear end portions in the foregoing embodiment, they may be provided in the middle portion or at the front end according to the invention. In the case that the lock recesses are provided at the front end, they may be formed by notching the front end edge of the engaging portion. With such lock recesses as well, portions before and after the thinned lock recesses are allowed to have a length short, but sufficient to be engaged with the locking portions as in the foregoing embodiment. Accordingly, the strength of the engaging portion is not reduced by changing the positions of the lock recesses.

Although the lock recesses are not open in the outer surfaces of the engaging portion in the foregoing embodiment, they may be recessed in the outer surfaces of the engaging portion according to the invention. Accordingly, they may be open in the outer surfaces of the engaging portion.

Although the locking means comprised of the locking portion and the lock recess is provided in two positions in the foregoing embodiment, it may be provided in one, three or more positions according to the invention.

Although the terminal fitting is comprised of the outer conductor and the inner conductor in the foregoing embodiment, the invention is also applicable to a single-piece terminal fitting having one conductive path.

The outer conductor, the insulating member and the inner conductor may be mounted or connected to each other by insert molding.

What is claimed is:

1. A connector mountable on a circuit board, comprising:

a housing having an engaging portion for permitting a mating connector to be fitted thereon from a mating direction, said engaging portion further having a terminal insertion opening extending therethrough, a terminal fitting having a connection section that is at least partially inserted from an insertion direction along an inner surface defined by the terminal insertion opening of the engaging portion so as to enable connection with a mating terminal fitting of the mating connector, the connection section of the terminal fitting having a front end for receiving the mating terminal fitting and an opposed rear end, elastic contact portions formed on the connection section of the terminal fitting in proximity to the front end thereof, said elastic contact portions projecting inwardly for elastic contact with the mating terminal fitting, and locking means provided on the housing and the terminal fitting for substantially preventing the connection section from being disengaged from the engaging portion, the locking means comprising at least one lock recess formed on the inner surface of the engaging portion and at least one corresponding locking portion on the connection section, the locking portion projecting obliquely backward on the connection section and having a leading end engageable with the lock recess, the locking portion being disposed between the elastic contact portion and the rear end of the connection section.

2. A connector according to claim 1, wherein the locking portion is formed by cutting a portion of the connection section and bending the cut portion obliquely backward.

3. A connector according to claim 2, wherein the locking portion is elastically deformable.

4. A connector according to claim 1, wherein the engaging portion is substantially tubular.

5. A connector according to claim 4, wherein the lock recess (18) is formed in a rear end position of the engaging portion.

6. A connector according to claim 1, wherein the terminal fitting comprises an outer conductor, an insulating member and an inner conductor, the inner and outer conductors being mounted to each other by the insulating member, and wherein the connection section is a part of the outer conductor.

7. A connector according to claim 6, wherein the inner conductor and the insulating member are at least partially insertable into the outer conductor in the insertion direction.

8. A connector according to claim 7, wherein the outer conductor comprises a wall portion that is bendable in such a position as to intersect the insertion direction.

9. A connector according to claim 8, wherein a portion of the engaging portion spaced from the lock recess has a longitudinal length longer than half a longitudinal length of the terminal fitting.

10. A connector according to claim 1, wherein the at least one elastic contact portion comprises a plurality of elastic contact portions disposed in spaced relationship in proximity to the front end of the connection section, and wherein the at least one locking portion comprises a plurality of locking portions each of which is disposed between the respective elastic contact portions and the rear end of the connection section.

* * * * *